United States Patent [19]

Coleman et al.

[11] 4,350,932

[45] Sep. 21, 1982

[54] METHOD OF PLASMA PANEL DRIVE TO REDUCE FLASH AND CREATE DIMMING

[75] Inventors: William E. Coleman; Stacy W. Hall, both of Colorado Springs, Colo.

[73] Assignee: NCR Corporation, Dayton, Ohio

[21] Appl. No.: 198,562

[22] Filed: Oct. 20, 1980

[51] Int. Cl.[3] ..... G09F 9/313; H05B 41/00

[52] U.S. Cl. ..... 315/169.2; 340/768

[58] Field of Search ..... 315/169.2, 169.4, 250; 340/768, 805

[56] References Cited

U.S. PATENT DOCUMENTS

| | | | |
|---|---|---|---|
| 3,781,600 | 12/1973 | Coleman et al. | 315/169 TV |
| 4,051,409 | 9/1977 | Craycraft | 315/169 TV |
| 4,132,924 | 1/1979 | Yamaguchi et al. | 315/169.2 X |

*Primary Examiner*—Eugene R. LaRoche

*Attorney, Agent, or Firm*—J. T. Cavender; Philip A. Dalton; Casimer K. Salys

[57] ABSTRACT

A method for suppressing the objectionable visual flash associated with replacing patterns in a "plasma-charge-transfer" shift mechanism type AC plasma shift display panel. During the erase mode, the load mode, or both, the phase voltage repetition rate is reduced until the time average luminous flux is substantially below the level of human perception in a room ambient light background. Upon entry into the hold mode, the phase voltage repetition rate reverts to a high frequency. The rapid rate generates patterns in the display panel which have a time average luminous flux adequate for viewing in the ambient light background. The visual flash is thereby suppressed without degrading the normal display characteristics of the panel.

5 Claims, 5 Drawing Figures

PRIOR ART

INPUT
$V_i$ 0
$\phi_A$
$V_S$ 0
$\phi_B$
$V_S$ 0
$\phi_C$
$V_S$ 0
$\phi_D$
$V_S$ 0
INPUT
$V_i$ 0
$\phi_A$
$V_S$ 0
$\phi_B$
$V_S$ 0
$\phi_C$
$V_S$ 0
$\phi_D$
$V_S$ 0
640μs
LOAD
40μs
HOLD

METHOD OF PLASMA PANEL DRIVE TO REDUCE FLASH AND CREATE DIMMING

BRIEF SUMMARY

The present invention is directed to a method for suppressing the objectionable visual flash associated with replacing patterns in a "plasma-charge-transfer" shift mechanism type AC plasma shift display panel. The flash is visually perceived when patterned data, in the form of plasma dots, either enters or leaves the display panel. Normally, during the erase and load segments of the operating sequence, the previously displayed pattern of plasma dots is shifted at a fixed rate to an erase position, as the input pattern dots are shifted to designated display panel locations. Once located, the new plasma dots are moved back and forth, at the same fixed rate, between adjacent phase electrodes of a pel position, generating a short pulse of luminous energy with each movement. Conventionally, the movement rate is commensurate with the time average luminous flux sought during the hold mode of the operating sequence. In the simple case, where the old and new patterns are substantially identical and uniform on the panel in space average luminous flux, the time average luminous flux from the display panel remains unchanged during pattern exchanges. However, since the individual dots are conventionally shifted across the panel at a rate, and in a time interval, beyond human perception, the prior level of space average luminous flux is spread evenly over the whole display panel for a brief instant of time, in terms of the human senses. To an observer it appears as a visual flash.

The invention defines a method by which the visually perceived flash normally created during the erase or load modes is substantially suppressed. The method, in one form, prescribes a reduced shift rate during the erase or load modes, operating sufficiently low in frequency that the time average luminous flux of the plasma dots is substantially unperceivable to the visual senses of a human observer while in a room ambient light setting. Upon completion of the load segment of the operating sequence, the hold mode phase rate is increased until the plasma dot pattern in the display panel has a time average luminous flux sufficient to be perceived visually.

DETAILED DESCRIPTION

Figure 1:
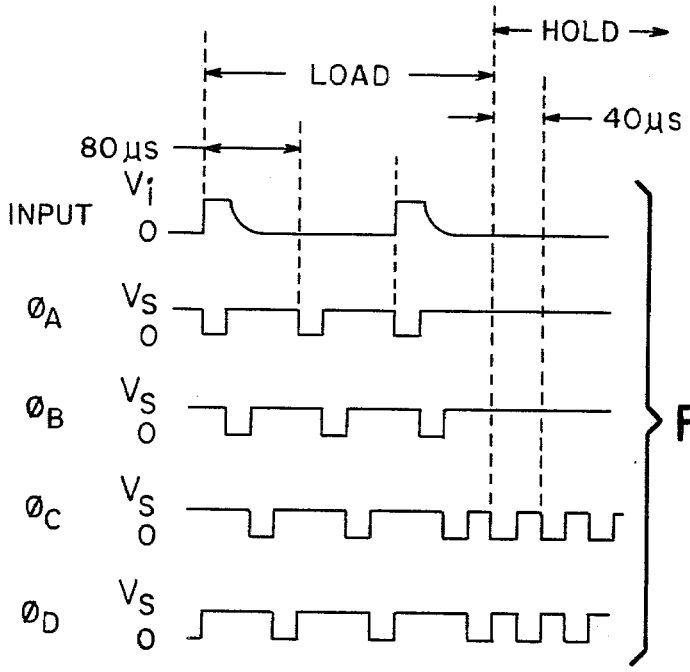
FIG. 1 contains time plots of phase and input voltage pulses depicting a conventional load and hold sequence.

The trend in recent years has been toward visual display systems generating both alphanumeric characters and patterns. One form of display uniquely suited for this application is the AC plasma shift panel utilizing the "plasma-charge-transfer" phenomenon. Representative examples of apparatus embodying this shift mechanism are described in U.S. Pat. Nos. 3,781,600 and 4,051,409, the subject matter of which is incorporated herein by reference. A commercially available device embodying the principles described in the above-noted art is marketed under the trademark PLASMAC II by the NCR Corporation. For the present, it suffices to note that the invention pertains to display panels of the form noted above, which operate by "plasma-charge-transfer" as distinguished from those using "priming" as the predominate shift mechanism.

Irrespective of which shift mechanism is utilized, plasma charge transfer or priming, luminous patterns are created in the display panels by shifting trapped charge from the input edges of a multiplicity of rows to designated locations within the display panel. The voltage pulses conventionally used to create and shift the trapped charge are adequately described in the prior art. Nevertheless, the important aspects will be described briefly hereinafter. The focus of attention in the present case is directed to phase voltage repetition rates during the erase, load and hold modes of the operating sequence, and methods for relating these modes to overcome the visual flash phenomenon.

The detracting effect known as visual flash occurs whenever new patterns are entered into the display panel. It is caused by the combination of a rapid shift rate and a short time interval over which the transfer of the plasma dot pattern is executed. Stated otherwise, the time average luminous flux is proportional to the frequency of the discharges and the number of plasma dots lit. The visually perceived flash is based on the time average luminous flux and the duration of the complete pattern transfer. Display systems utilizing priming as the shift mechanism between electrodes are particularly offensive, since each movement is preceded by a multiplicity of priming discharges.

Previous attempts to suppress the flash, or substantially reduce its intensity, were not wholly satisfactory. As an example, one technical approach having moderate success required the display panel to be de-energized during a time interval immediately preceding the load mode. The flash attributable to the erase transfer was thereby eliminated, leaving only the load transfer flash. Though the average flash intensity was apparently reduced by one half, some flash remained and the technique was beneficial only to the extent that pre-existing patterns required erasure.

As a prelude to describing the art and the invention embodiments in detail, it is appropriate to define some terms which are used in the ensuing description and are intended to convey specific functional meanings. Within the body of this disclosure the term "shift" pertains to a visually perceived movement of luminous dots between pel positions in the display panel. Each such pel position represents a dot location when the panel is operating in the hold mode. The term "phase" conveys a relationship between structurally organized groups of panel electrodes and the voltages applied thereto. For purposes of the ensuing embodiments the electrodes and their energizing voltages are comprised of four distinct phases, A-D, which are synchronized in the manner of the prior art. Following from the above, each pulse of phase voltage causes a movement of trapped charge and a corresponding output pulse of luminous energy from the display panel.

Attention is now directed to FIG. 1 of the drawings. The plots depicted represent exemplary prior art voltage waveforms at the input electrode of one row and the four phase electrodes of the same display panel. The plots show that trapped charge is created at the row input during the first and third segments of the load operation, that the phase sequence to complete entry of each plasma dot entails four moves of 20 microseconds duration each, and that the panel undertakes a hold mode with 20 microseconds between moves immediately after all the dot data is entered. Recalling from the prior teachings that the time average luminous flux of each pel position dot is substantially proportional to the rate charge transfers are performed, it becomes apparent that the 20 microsecond transfer rate during the hold mode defines an appropriate rate to properly illuminate the dots of the embodying display panel. Note, however, the same level of time average luminous flux is generated during the load segment of the operating sequence.

The method of the invention departs from the practice in the art by significantly altering the phase voltage repetition rate during the erase and load modes of operation, individually or together, to suppress the visual flash normally attendant those segments of the operating sequence. In selectively modifying the operating rates, recognition is given to the averaging effect of the human visual senses. Namely, plasma dot data is still moved to the erase side of the display panel as new data is entered by way of the input side, but the time average luminous flux is reduced to a level below perception when operated in a background of room ambient light. Reversion to the conventional phase voltage pulse repetition rate during the hold segment of the operating sequence elevates the luminence back to the level required for patterns to be readily discerned in an ambient light background.

Representative embodiments of the operating method described above appear in FIGS. 2A and 2B of the drawings. Both of the methods shown depict only the load and hold segments of the operating sequence, since the phase voltage during the erase segment is identical to the load segment.

Figures 2A, 2B:
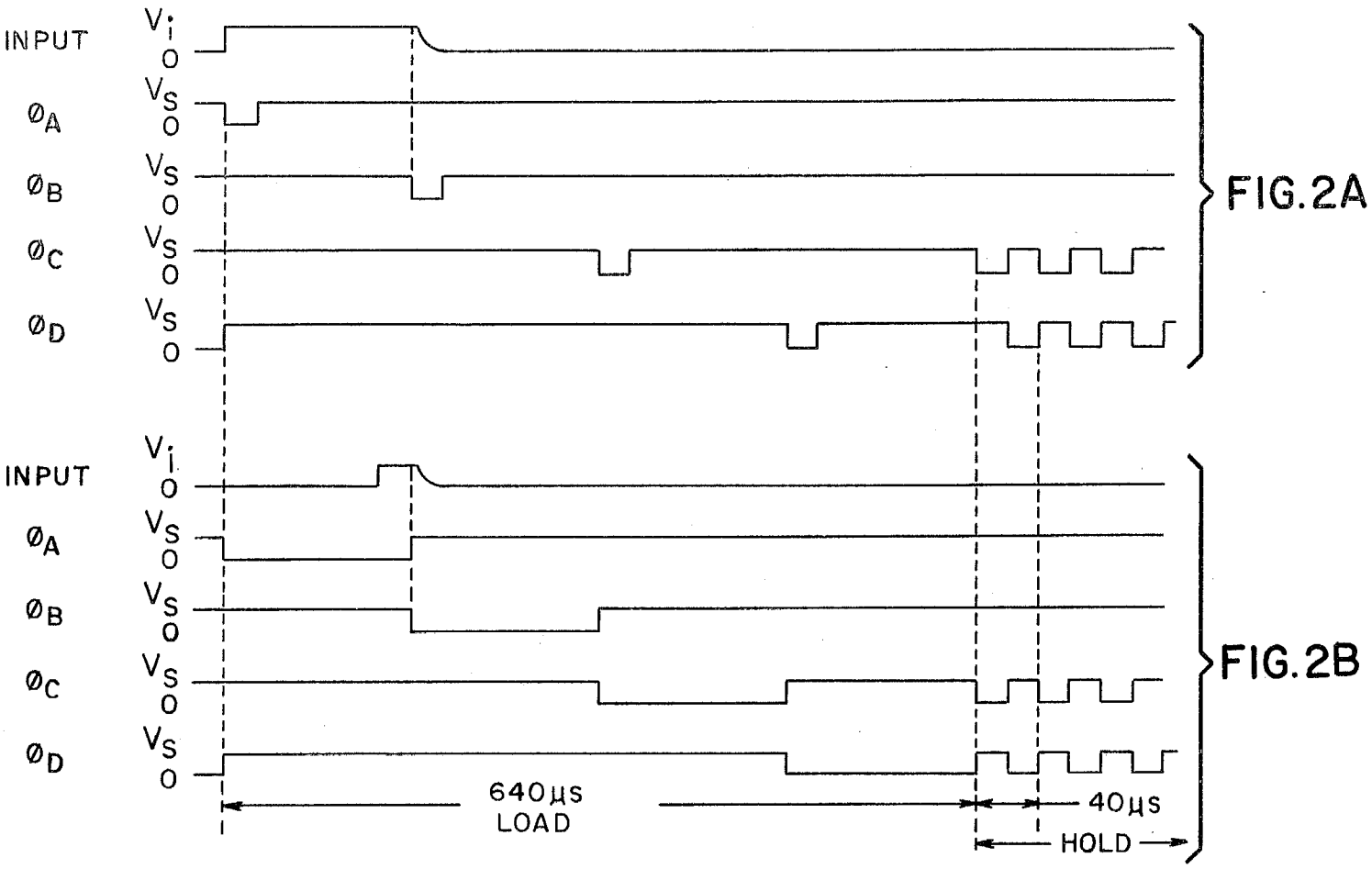
FIG. 2A presents time plots of phase and input voltage pulses for the flash suppressing technique known as the "fixed pulse width mode."
FIG. 2B presents time plots of phase and input voltage pulses for the flash suppressing technique known as the "wide pulse mode."

The embodiment in FIG. 2A is known as the "fixed pulse width mode." According to that method, the zero level pulses of phase voltage, causing transfer of trapped charge, are under 20 microseconds in duration and are followed by pulse delay periods of approximately 140 microseconds. The phases, A to D, follow each other in the ordered sequence shown until the trapped charge created at the input reaches the hold location of the first pel position. Thereupon, the hold sequence is initiated. As shown on the plot, the hold sequence entails back and forth movements of the trapped charge between phase C and phase D electrodes at a repetition rate with a 20 microsecond period. Other hold schemes are also available, an example being that taught in the second of the above-noted U.S. patents. Undoubtedly one recognizes that the load sequence must be repeated to move the trapped charge an additional pel position.

Another embodiment, applicable in like manner to both the erase and hold operating modes, is shown in FIG. 2B. This method, hereafter referred to as the "wide pulse mode," contemplates zero level pulses of phase voltage extending the full 160 microseconds of each phase segment. As was true of the previous embodiment, the trapped charge is shown to be shifted into the first pel position before the hold sequence is initiated.

Next, attention is directed to the input voltage waveforms appearing in FIGS. 2A and 2B. Note two characteristics that exist in both embodiments. First, the input voltage is at level $V_i$ during a time when phase A voltage is at the zero level. And second, the input voltage level $V_i$ persists until after the fall of phase B voltage to the zero level. The first-mentioned relationship facilitates creation of trapped charge, while the second prevents the deleterious phenomenon known as backfire, described in the first noted of the U.S. patents. Experience has also shown that the rise of input voltage to $V_i$ should be initiated approximately 20 microseconds before the rise in phase A voltage when "wide pulse mode" shown in FIG. 2B is selected.

Figure 3:
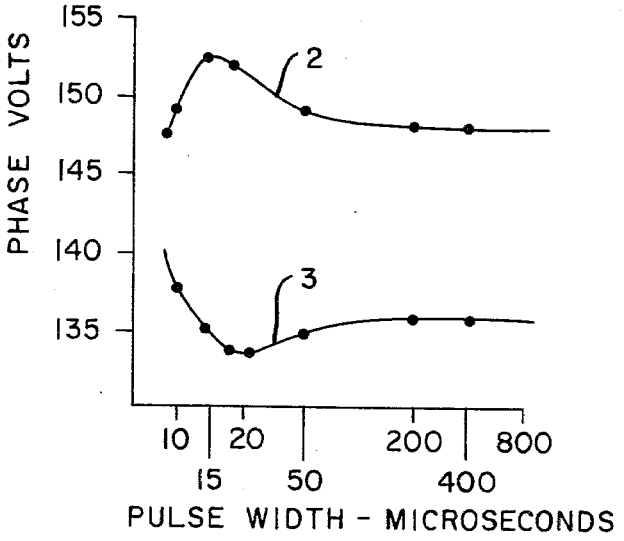
FIG. 3 contains a plot of operating window vs. pulse width for an apparatus embodying the present method.

The invention fully contemplates other rates for the erase and load modes of operation. From the foregoing, it is clear that slower erase and load modes proportionately lessen the visual flash in the display. However, practical considerations evolving from the slower entry of new data, especially in large display panels, set a lower bound on the rate. Other considerations in prescribing a lower limit on the rate are associated with the relationship of the operating window to the pulse width, as represented in FIG. 3, and the input voltage vs. phase voltage relationship appearing in the Shmoo curve of FIG. 4. Though the plots in both figures are typical of PLASMAC II performance, the individual devices and test constraints to obtain the data plotted in the former figure are distinguishable from those utilized in the latter figure. Consequently, the figures best illustrate trends rather than absolute values.

Consider the operating window aspect first. Upper plot 2 defines the maximum phase voltage possible without creating extra dots, while lower plot 3 prescribes the minimum phase voltage necessary to prevent inadvertent losses of dots. Lying therebetween is the nominal operating range. Note that the rapid degradation in operating window for pulse widths in excess of 20 microseconds stabilizes just after 50 microseconds. Thus, the constraints on phase voltage remain reasonable as the pulse width is extended according to the method taught herein.

Figure 4:
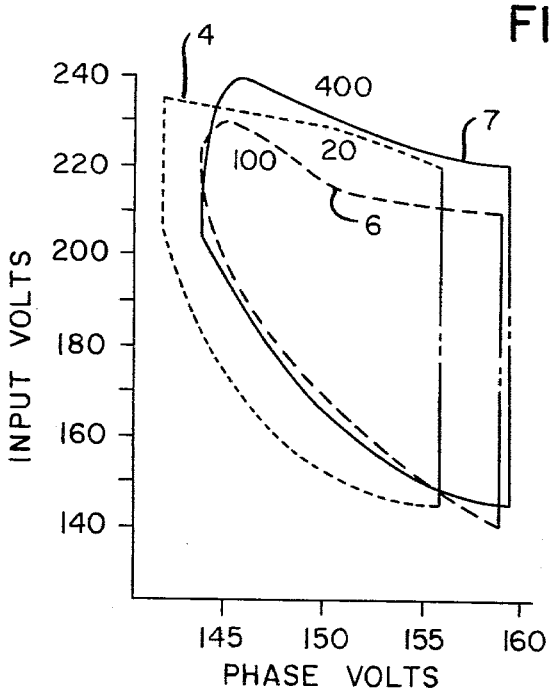
FIG. 4 is a Shmoo curve of input voltage vs. phase voltage at various pulse widths.

The Shmoo curve appearing in FIG. 4 confirms the viability of extending the pulse widths in view of the constraints between input voltage and phase voltage. As shown there, the deterioration in operating margin between a pulse width period of 20 microseconds, the plot designated by reference numeral 4, and the 100 and 400 microsecond periods designated by numerals 6 and 7, respectively, show that extended pulse operations are feasible. For contrast, note the rapid degradation of operating margin between the 20 microsecond pulses of plot 4 and the 100 microsecond pulses of plot 6.

The time plots of voltage in FIGS. 2A and 2B show a phase voltage time interval of 160 microseconds between moves of the trapped charge. In contrast, the prior art according to FIG. 1 shows a 20 microsecond time interval, as does the hold mode in all cases. Recalling that a pulse of luminous energy is generated with each movement of trapped charge, and the averaging effect of the human visual senses, the embodying 8:1 increase in time interval produces an 8:1 decrease in the time average luminous flux of the flash occurring during the erase and load segments of the operating sequence. Experience has shown that a nominal 4:1 change is necessary to adequately suppress flash in a display panel when operating with a room ambient light background.

We claim:

1. A method for suppressing the visual flash associated with replacing patterns in a "plasma-charge-transfer" shift mechanism type AC plasma shift display panel, comprising the steps of:

reducing the phase voltage repetition rate during the load segment of the operating sequence until the time average luminous flux is substantially unperceivable in a room ambient light background; and increasing the phase voltage repetition rate during the hold segment of the operating sequence until the time average luminous flux is visually perceivable in a room ambient light background.

2. The method recited in claim 1, further comprising the step of:

reducing the phase voltage repetition rate during the erase segment of the operating sequence, immediately preceding the load segment, until the time average luminous flux is substantially unperceivable in a room ambient light background.

3. The method recited in claim 2, wherein the phase voltage repetition rate during the load and hold segments of the operating sequence are selected so that the time average luminous flux during the hold segment exceeds that during the load segment by a factor in excess of 4.

4. The methods recited in claims 1, 2 or 3, and directed to the operation of a display panel energized with input voltage pulses and a multiplicity of sequentially occurring phase voltage pulses, comprising the further steps of:

adjusting the duration of each phase voltage pulse to be substantially identical and a substantially equal portion of the load segment time interval;

extending the duration of the input voltage pulse, during the load segment of the operating sequence, to coincide in time with the first occurring phase voltage pulse, and to extend in time to a point after the onset of the second occurring phase voltage pulse; and setting the onset of the input voltage pulse at a point time proximate to the onset of the second occurring phase voltage pulse.

5. The methods recited in claims 1, 2 or 3, and directed to the operation of a display panel energized with input voltage pulses and a multiplicity of sequentially occurring phase voltage pulses, comprising the further steps of:

adjusting the duration of each phase voltage pulse to be a substantially small portion of the load segment time interval; and extending the duration of the input voltage pulse, during the load segment of the operating sequence, to coincide in time with the first occurring phase voltage pulse, and to extend in time to a point after the onset of the second occurring phase voltage pulse.

* * * * *